US010458149B2

(12) United States Patent
Densmore

(10) Patent No.: US 10,458,149 B2
(45) Date of Patent: Oct. 29, 2019

(54) LOCK APPARATUS

(71) Applicant: Scott A. Densmore, Littleton, CO (US)

(72) Inventor: Scott A. Densmore, Littleton, CO (US)

( * ) Notice: Subject to any disclaimer, the term of this patent is extended or adjusted under 35 U.S.C. 154(b) by 11 days.

(21) Appl. No.: 15/822,118

(22) Filed: Nov. 25, 2017

(65) Prior Publication Data

US 2018/0073270 A1 Mar. 15, 2018

Related U.S. Application Data

(63) Continuation-in-part of application No. 14/513,546, filed on Oct. 14, 2014, now abandoned.

(60) Provisional application No. 62/031,270, filed on Jul. 31, 2014.

(51) Int. Cl.

| | |
|---|---|
| ***E05B 13/00*** | (2006.01) |
| ***E05B 17/20*** | (2006.01) |
| ***E05B 63/00*** | (2006.01) |
| *E05B 9/08* | (2006.01) |

(52) U.S. Cl.

CPC ..... *E05B 13/002* (2013.01); *E05B 13/005* (2013.01); *E05B 17/2003* (2013.01); *E05B 17/2084* (2013.01); *E05B 63/0017* (2013.01); *E05B 9/084* (2013.01); *E05B 17/2038* (2013.01)

(58) Field of Classification Search

CPC ..... Y10T 292/0969; Y10T 292/82; Y10T 292/85; Y10T 292/865; Y10T 292/93; Y10T 292/96; E05B 13/002; E05B 13/005; E05B 63/0017; E05B 17/2003; E05B 17/2084; E05B 17/2038; E05B 9/084; E05B 13/101; E05B 13/106; E05B 47/0676; E05B 47/068; E05B 47/0638; E05B 47/0642

USPC ..... 292/DIG. 27; 70/472, 422, 149, 188, 70/189, 280–283, 283.1, 416, 379 R, 70/379 A, 380, 218, 222, 223, 277, 278.1, 70/278.2, 278.3, 278.7, 279.1

See application file for complete search history.

(56) References Cited

U.S. PATENT DOCUMENTS

| | | | | |
|---|---|---|---|---|
| 1,125,791 A * | 1/1915 | Aston | ..... | E05B 13/005 70/134 |
| 1,505,865 A * | 8/1924 | Costa | ..... | E05B 27/00 70/120 |
| 1,686,406 A * | 10/1928 | Caplan | ..... | E05B 55/005 292/DIG. 27 |

(Continued)

FOREIGN PATENT DOCUMENTS

DE 102014110857 A1 * 2/2016

*Primary Examiner* — Lloyd A Gall
(74) *Attorney, Agent, or Firm* — Roger A. Jackson

(57) ABSTRACT

A lock and method of use for securing and un-securing first and second articles, the lock comprises a first element rotationally engaged about a longitudinal axis to the first article, an extension beam rotationally engaged about a lengthwise axis to the first article, the lengthwise and longitudinal axes are coincident, the beam has structure to rotationally engage and disengage the first element. Also included is structure to engage and disengage the second article that is driven from the beam, wherein operationally the beam rotationally engages the first element and the extension beam engages and disengages the first and second articles, resulting in the beam always being able to engage and disengage the first and second articles and the first element only having an ability to engage and disengage the first and second articles when the first element and the beam are rotationally engaged to one another.

16 Claims, 11 Drawing Sheets

(56) References Cited

U.S. PATENT DOCUMENTS 1,804,781 A * 5/1931 Keeler ..... E05B 13/101 292/DIG. 27
1,855,697 A * 4/1932 Sullivan ..... E05B 13/101 192/114 R
2,017,530 A * 10/1935 De Orlow ..... E05B 13/101 292/DIG. 27
2,497,328 A * 2/1950 Smith ..... E05B 55/005 292/169.18
2,911,815 A * 11/1959 Crepinsek ..... E05B 55/005 292/170
3,792,885 A * 2/1974 Giardina ..... E05B 13/005 292/150
4,679,418 A * 7/1987 Allen ..... E05B 17/042 70/134
5,421,074 A * 6/1995 Moore ..... E05B 13/002 29/401.1
5,651,568 A * 7/1997 Fortune ..... E05B 53/00 292/140
5,816,086 A * 10/1998 Russell, IV ..... E05B 13/101 70/422
6,729,169 B2 * 5/2004 Moore ..... E05B 63/0065 70/149
6,807,833 B1 * 10/2004 Huang ..... E05B 13/101 70/107
6,912,882 B1 * 7/2005 Alonso ..... E05B 13/108 292/142
7,207,199 B2 * 4/2007 Smith ..... E05B 13/00 292/150
7,559,219 B2 * 7/2009 Chen ..... E05B 55/005 292/336.3
7,712,343 B2 * 5/2010 Smith ..... E05B 13/004 292/359
7,748,244 B2 * 7/2010 Garza ..... E05B 63/0017 292/166
8,939,477 B2 * 1/2015 Welsby ..... E05B 55/005 292/347
2004/0139773 A1 * 7/2004 Chang ..... E05B 13/005 70/416

* cited by examiner

LOCK APPARATUS

RELATED PATENT APPLICATIONS

This is a continuation in part (CIP) patent application of U.S. patent application Ser. No. 14/513,546 (now abandoned) filed on Oct. 14, 2014 by Scott A. Densmore of Sedalia, Colo., US, that in turn claims the benefit of U.S. provisional patent application Ser. No. 62/031,270 filed on Jul. 31, 2014 by Scott A. Densmore of Sedalia, Colo., U.S.

FIELD OF THE INVENTION

The present invention generally relates to locks that interface between a first article and a second article. More particularly, the present invention discloses a deadbolt type lock that interfaces between a door and a door frame.

DESCRIPTION OF THE RELATED ART

Prior art typical deadbolt locks are typically constructed of an exterior key lock cylinder that is rotationally coupled to the bolt assembly that has a mechanism to convert the rotational movement from the lock cylinder into reciprocating movement in the bolt assembly that moves into and out of the door frame, wherein the lock cylinder is rotationally engaged to the door, thus with the bolt extension assembly extended into the door frame this results in the door being locked to the door frame. Further included in the typical deadbolt lock is an interior thumb turn handle that is also rotationally engaged to the door and the bolt extension assembly like the key lock cylinder except that the thumb turn handle can manually place the bolt assembly extended into or retracted out of the door frame.

One of the security concerns with the deadbolt lock is on the key lock cylinder that is on the external side of the door, wherein a person with evil intent would try to breach the lock cylinder with a master key or even a locksmiths key picking ratchet to have the key lock cylinder rotate as though the evil intent person had the correct key to turn the lock cylinder, thus being able to rotate the key lock cylinder and resulting in the bolt extension assembly withdrawing from the door frame and effectively unlocking the door without using the correct key, thus emphasizing that the unique configuration of the key is not much of a barrier for a motivated and resourceful criminal to overcome the typical prior art dead bolt lock. One possible solution to removing the weak deterrent effect of requiring a unique key to rotate the key lock cylinder is to be able to selectively rotationally disconnect the rotational engagement of the key lock cylinder from the bolt extension assembly all from the inside portion of the door via the thumb turn handle, thus resulting that if the key lock cylinder is overcome with a bogus key or even in the case of the criminal having the correct key, being irrelevant toward overcoming dead bolt in retracting the bolt extension assembly from the door frame and being able to open the door.

Further, even if a criminal were to use the incorrect key in the key lock cylinder and impart excessive rotational force, bump, or even drill out the key lock cylinder to overcome the key lock cylinder not rotating from the wrong key being in it would also be irrelevant as the key lock cylinder is rotationally disengaged from the bolt assembly thus resulting in the dead bolt remaining locked no matter what happens to the key lock cylinder. Even with an electronic key, there could be an instance of it being hacked and being overcome as if the criminal had the correct key code would still not allow the dead bolt to become unlocked-truly making the lock apparatus a "dead" bolt, wherein the bolt cannot be changed from its locked positional state via the exterior key lock cylinder.

In looking at the prior art in this area, starting with U.S. Pat. No. 7,207,199 to Smith, et al., disclosed is a deadbolt mechanism including a lock out mechanism that functions to disable the operation of the deadbolt from at least one side of the deadbolt mechanism. In Smith '199 the deadbolt mechanism includes a deadbolt, key cylinder, housing, turn knob and a shaft that connects the key cylinder and turn knob. To place the deadbolt mechanism in Smith '199 into lock out mode, the turn knob is moved to the locked positioned and then pulled outward away from the door. By pulling the knob outward, the shaft engages a portion of the housing which prevents rotation of the shaft and thereby prevents movement of the deadbolt from the locked position. A problem with Smith '199 is that a mechanical rotational lockout effectuates the rotational lock-up of the shaft between the thumb turn handle and the key lock cylinder with the bolt assembly rotationally disposed therebetween, wherein if excessive rotational force is applied externally to the key lock, it could overcome the rotational lock which would breach the entire deadbolt lock, thus a better design would have the rotational dis-engagement of the key lock assembly thus allowing the key lock assembly to rotationally "free wheel" in relation to the bolt assembly and the thumb turn handle such that if excessive rotational force is applied to the key lock assembly to breach the dead bolt lock it would not matter.

Further in the dead bolt lock prior art in U.S. Pat. No. 7,712,343 to Smith, et al., disclosed is a deadbolt mechanism including a lock out mechanism (100) that functions to disable the operation of the deadbolt from at least one side of the deadbolt mechanism. The deadbolt mechanism in Smith '343 includes a deadbolt, key cylinder, housing, turn knob and a shaft that connects the key cylinder and turn knob. In Smith '343 to place the deadbolt mechanism in lock out mode, a release mechanism is actuated and the turn knob is pulled outward away from the door.

Further in Smith '343, by pulling the knob outward, the shaft engages a portion of the housing which prevents rotation of the shaft and thereby prevents movement of the deadbolt from the lock-out position. Again as in Smith '199, Smith '343 has the problem in that a mechanical rotational lockout effectuates the rotational lock-up of the shaft between the thumb turn handle and the key lock cylinder with the bolt assembly rotationally disposed therebetween, wherein if excessive rotational force is applied externally to the key lock, it could overcome the rotational lock which would breach the entire deadbolt lock, thus a better design would have the rotational dis-engagement of the key lock assembly thus allowing the key lock assembly to rotationally "free wheel" in relation to the bolt extension assembly and the thumb turn handle such that if excessive rotational force is applied to the key lock assembly to breach the dead bolt lock it would not matter.

Continuing in the deadbolt lock prior art, in U.S. Pat. No. 6,729,169 to Moore disclosed is a deadbolt manipulation adjunct and method that provides user selection between dual cylinder, single cylinder, and disabled modes, is capable of retrofitting on existing deadbolt structures, which maintains full deadbolt security while providing authorized user deadbolt operation between locked and unlocked positions via a thumb turn actuator to release the deadbolt in the case of an emergency. Moore '169 provides especially the emergency opening release of the key locked interior deadbolt type lock, wherein the dead bolt lock can be selectively set to function as a conventional non-key required interior thumb type turn handle to facilitate emergency exit situations wherein a key would not be easily available to open the dead bolt lock from inside the building structure.

Next in the dead bolt lock prior art area in U.S. Pat. No. 7,748,244 to Garza, et al., disclosed a lock assembly for use with a bolt movable from a retracted position to an extended position from outside the house. The lock assembly in Garza includes an exterior assembly and an interior assembly having an interior actuator manually operable to move the bolt extension between the retracted position and the extended position. The exterior assembly in Garza includes an exterior actuator manually operable to cause the bolt extension to move from the retracted position to the extended position and inoperable to move the bolt extension from the extended position to the retracted position. Thus the result in Garza is that the exterior portion of the dead bolt has an added actuator that functions to only lock the dead bolt without the need for a key.

Further in the dead bolt lock prior art area in U.S. Pat. No. 5,421,074 to Moore, disclosed is a conversion kit allows a user to convert a deadbolt lock mechanism into a pick proof deadbolt lock mechanism by providing all the necessary parts allowing a user to easily and effectively prevent the turn piece latch of the deadbolt lock mechanism from rotating. Once installed in Moore '074, a locking shaft pin of the kit can be placed into a first orifice drilled through the turn piece latch and a second orifice, coaxially aligned with the first orifice, drilled through the back plate to immobilize the turn piece latch in its locked position from the interior side of the dead bolt lock, further it would also allow a deadbolt manufacturer to use the same, in which case collars could be an O-ring style.

In Moore '074 there is the same issue as with Smith '199 and Smith '343 in that the problem is with the mechanical fixed rotational lockout via rod 6, that effectuates the rotational lock-up of the shaft between the thumb turn handle and the key lock cylinder with the bolt assembly rotationally disposed and bolt extension assembly locked therebetween, wherein if excessive rotational force is applied externally to the key lock, it could overcome via rotationally overloading the rotational lock which would breach the entire deadbolt lock, thus again a better design would have the rotational dis-engagement of the key lock assembly thus allowing the key lock assembly to rotationally "free wheel" rotationally in relation to the bolt extension assembly and the thumb turn handle such that if excessive rotational force is applied to the key lock assembly to breach the dead bolt lock it would not matter toward breaching the dead bolt lock.

What is needed is a lock out mechanism that safely selectively dis-engages the key lock assembly from the bolt extension assembly from the interior side of the door such that the application of significant rotational force against the exterior key lock assembly with or without the correct key by a criminal does not have the opportunity to cause damage to the dead bolt lock as the rotationally disengaged key lock assembly is simply rotationally "freewheeling" via not offering any rotational resistance for the criminal to apply a force toward, that can potentially cause an element to fail within the dead bolt lock assembly. In summarizing the above mentioned prior art in the current state of the art in deadbolt locks that have various disengagement mechanisms, starting with Smith '199 whose patentability is in an inside pullout for the deadbolt extension lock, in Smith '343 whose patentability lays in a lockout mechanism (100) as an example to prevent accidental key disabling lockout, in Moore '169 whose patentability lays in having different locking options with a double ended key lock deadbolt lock assembly, in Garza whose patentability lays in the ability to activate (irreversibly) the key deactivation from the outside, and in Moore '074 whose patentability is in retrofitting existing installed dead bolt locks. So there are a number of differing approaches to adding dead bolt lock security with various advantages and disadvantages disclosed.

SUMMARY OF INVENTION

Broadly, the present invention is a lock apparatus for selectively securing and un-securing a first article to a second article, the lock apparatus comprises a first element including a primary end portion and an opposing secondary end portion with a longitudinal axis spanning therebetween, the first element having a first element rotational engagement about the longitudinal axis to the first article. Further included in the lock apparatus is an extension beam including a first end portion and an opposing second end portion with a lengthwise axis spanning therebetween, the extension beam having an extension beam rotational engagement about the lengthwise axis to the first article, wherein the lengthwise axis and the longitudinal axis are coincident to one another, wherein the extension beam second end portion has a structure to selectively rotationally engage and disengage the first element secondary end portion.

Also included in the lock apparatus is a means to selectively engage and disengage the second article that is driven from the extension beam, wherein operationally the extension beam selectively rotationally engages the first element and the extension beam selectively engages and disengages the first article to the second article, thus resulting in the extension beam always being able to selectively engage and disengage the first article to the second article and the first element only having an ability to selectively engage and disengage the first article to the second article when the first element and the extension beam are selectively rotationally engaged to one another.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 7 shows an exploded perspective view that is reversed from FIG. 6, wherein FIG. 7 shows the extension beam with the lengthwise axis with the second end portion male structure, plus the second end portion female portion of the structure, also with the structure to rotationally engage and disengage the first element secondary end portion shown as the "D" shaped profile for the male and female portions-however any other shape would be acceptable, further the means for urging the male and female portions apart from one another to disengage the rotational engagement state as the not being rotationally engaged state is shown;

REFERENCE NUMBERS IN DRAWINGS

Figure 1:
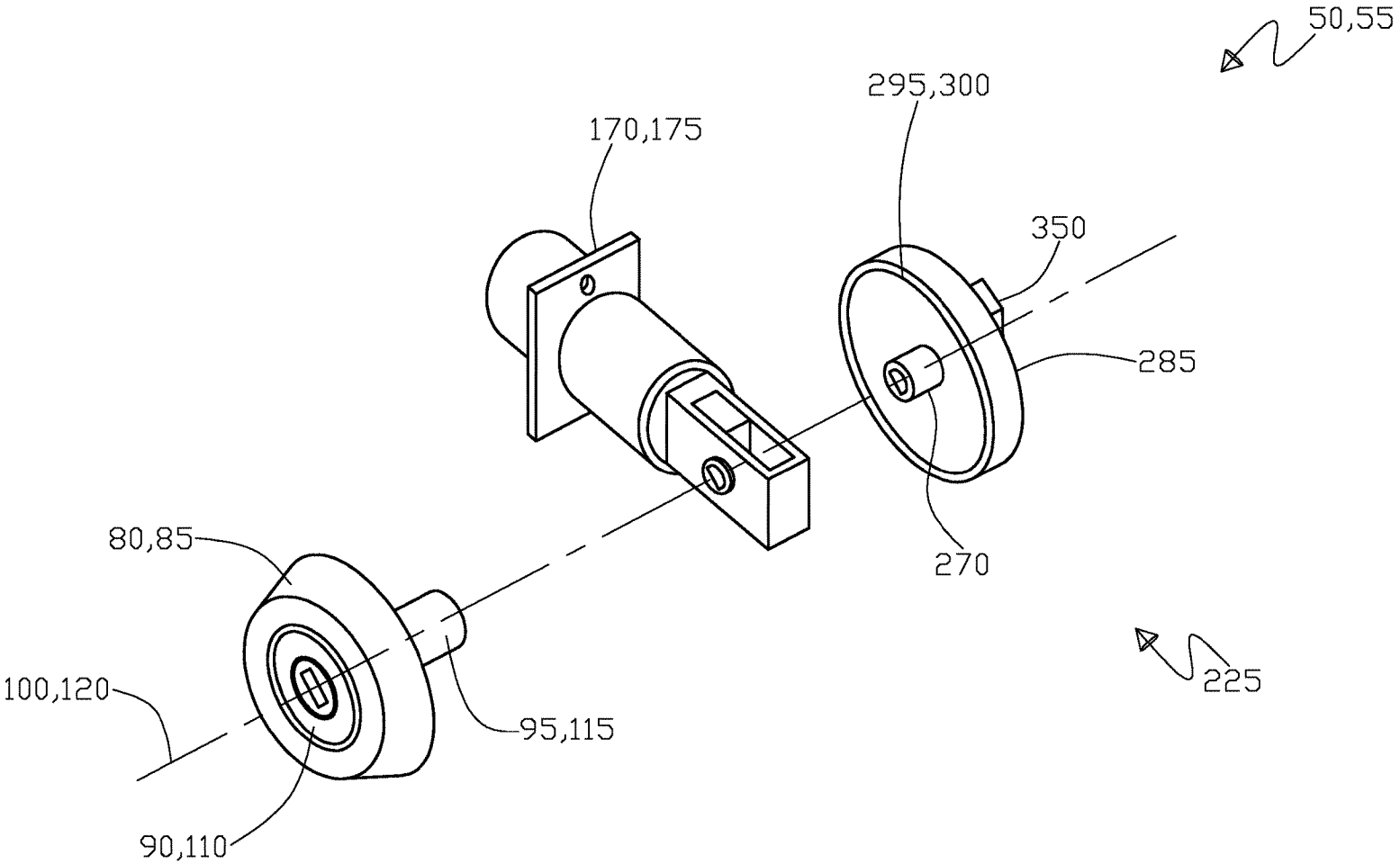
FIG. 1 shows an exploded perspective view of the lock apparatus minus the extension beam for pictorial clarity to easily show the lock cylinder with the primary and secondary end portions of the lock cylinder, plus the longitudinal axis of the lock cylinder, also the bolt extension assembly and the twist lock assembly with a lever are shown.

50 Lock Apparatus
55 Dead bolt lock apparatus
60 First article
65 Door
70 Second article
75 Door frame
80 First element
85 Lock cylinder
90 Primary end portion of the first element 80
95 Secondary end portion of the first element 80
100 Longitudinal axis of the first element 80
105 Rotational engagement about the longitudinal axis 100 of the first element 80 to the first article 60
110 Primary end portion of the lock cylinder 85
115 Secondary end portion of the lock cylinder 85
120 Longitudinal axis of the lock cylinder 85
125 Rotational engagement about the longitudinal axis 120 of the lock cylinder 85 to the door 65
130 Extension beam
135 First end portion of the extension beam 130
145 Second end portion of the extension beam 130
150 Lengthwise axis of the extension beam 130
155 Rotational engagement about the lengthwise axis 150 of the extension beam 130 to the first article 60 or door 65
160 Co-incident position of the lengthwise axis 150 to the longitudinal axis 100
165 Structure to selectively rotationally engage and disengage the first element 80 secondary end portion 95 or lock cylinder 85 secondary end portion 115
170 Means to selectively engage and disengage the second article 70 that is driven from the extension beam 130
175 Bolt extension assembly to selectively engage and disengage the door frame 75 that is driven from the extension beam 130
180 Male portion of the structure 165, shown as a "D" shaped profile wherein any other rotational drive profile would be acceptable
185 Female portion of the structure 165, shown as a "D" shaped profile wherein any other rotational drive profile would be acceptable
190 Rotational engagement state of the male 180 and female 185 portion of the structure 165 facilitating rotational movement as between the extension beam 130 second end portion 145 to the first element 80 secondary end portion 95

195 Rotational engagement state of the male 180 and female 185 portion of the structure 165 facilitating rotational movement as between the extension beam 130 second end portion 145 to the lock cylinder 85 secondary end portion 115

200 Means for urging the male 180 and female 185 portions apart from one another to disengage the rotational engagement state 190 as between the male 180 and female 185 portions into the rotationally disengaged state of the extension beam 130 second end portion 145 to the first element 80 secondary end portion 95

205 Means for urging the male 180 and female 185 portions apart from one another to disengage the rotational engagement state 195 as between the male 180 and female 185 portions into the rotationally disengaged state of the extension beam 130 second end portion 145 to the lock cylinder 85 secondary end portion 115

210 Default bias toward the extension beam 130 second end portion 145 and the first element 80 secondary end portion 95 not being rotationally engaged in a rotationally disengaged state from the means 200 for urging the male 180 and female 185 portions apart from one another

215 Default bias toward the extension beam 130 second end portion 145 and the lock cylinder 85 secondary end portion 115 not being rotationally engaged in a rotationally disengaged state from the means 205 for urging the male 180 and female 185 portions apart from one another

220 Spring for the means 200/205 for urging the male 180 and female 185 portions apart from one another

225 Twist lock assembly

230 Rotational engagement of the twist lock assembly 225 to the first article 60

235 Rotational engagement of the twist lock assembly 225 to the door 65

240 Rotational engagement of the twist lock assembly 225 to the extension beam 130 first end portion 135

245 Rotational movement of the twist lock assembly 225 about the lengthwise axis 150

250 First axial position of the twist lock assembly 225

255 Free movement axial state of the twist lock assembly 225

260 Means to removably lock the first axial position 250

265 Fixed amount of rotation about the lengthwise axis 150 to unlock the twist lock assembly

225 from the first axial position 250 to the free movement axial state 255

270 First extension element

275 Second extension element

280 Parallel position of the first 270 and second 275 extension elements to the lengthwise axis 150

285 Retainer

290 Rotational engagement of the retainer 285 to the first 270 and second 275 extension elements

295 Affixed position of the retainer 285 to the first article 60

300 Affixed position of the retainer 285 to the door 65

305 Interlock axially of the first extension element 270 and the retainer 285 forming the first axial position 250

310 Axially affixed position of the first 270 and second 275 extension elements to one another along the lengthwise axis 150 via an axial interface

315 Independent rotational movement about the lengthwise axis 150 as between the first 270 and second 275 extension elements

320 Rotational engagement of the second extension element 275 to the extension beam 130 first end portion 135

325 Inner sleeve that can be partial sleeve and partial solid

330 Outer sleeve

335 Circular clip to axially connect the inner 325 and outer 330 sleeve to one another

340 Independent rotational movement as between the inner 325 and outer 330 sleeves

345 Thumbscrew type manual grasping point of the outer sleeve 330

350 Lever type manual grasping point for the inner sleeve 325

355 Turning the lever 350 manually about the lengthwise axis 150 that turns the extension beam 130 that subsequently causes the bolt extension assembly 175 to engage the door frame 75 thus operationally securing the door 65 to the door frame 75

360 Turning the thumbscrew 345 manually about the lengthwise axis 150 to change from the first axial position lock 250 to the free movement axial state 255, thus operationally disengaging the extension beam 130 from the lock cylinder 85 thus disabling the lock cylinder 85 from being able to disengage the bolt assembly 175 from the door frame 75

365 Pushing manually the thumb screw 345 along the lengthwise axis 150 toward the lock cylinder 85 to engage the male 180 and female 185 portions thus taking the outer sleeve 330 from the free movement axial state 255 to the first axial position lock 250 with an additional manual turn of the lever 350 thus rotationally having the lock cylinder 85 engaged to the extension beam 130 that is engaged to the bolt extension assembly 175

DETAILED DESCRIPTION

With initial reference to FIG. 1 shown is the exploded perspective view of the lock apparatus 50 minus the extension beam 130 for pictorial clarity to easily show the lock cylinder 85 with the primary 90 and secondary 95 end portions of the lock cylinder 85, plus the longitudinal axis 120 of the lock cylinder 85, also the bolt extension assembly 175 and the twist lock assembly 225 with a lever 350 are shown.

Figure 2:
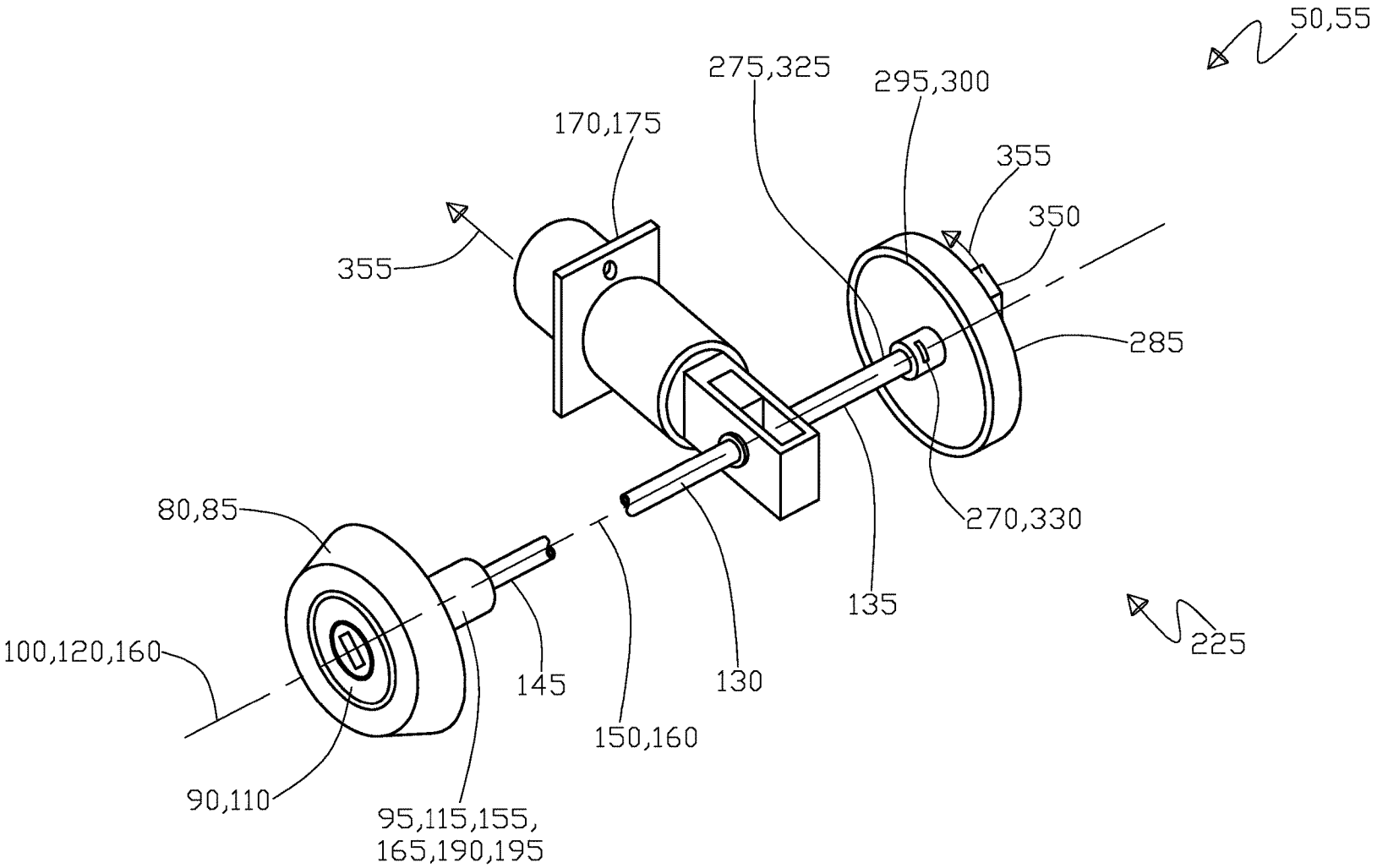
FIG. 2 shows an exploded perspective view of the lock apparatus that includes the extension beam with a lengthwise axis of the extension beam, the lock cylinder with the primary and secondary end portions of the lock cylinder, plus the longitudinal axis of the lock cylinder, also the bolt extension assembly and the twist lock assembly with a lever are shown.

Continuing, FIG. 2 shows an exploded perspective view of the lock apparatus 50 that includes the extension beam 130 with a lengthwise axis 150 of the extension beam 130, the lock cylinder 85 with the primary 90 and secondary 95 end portions of the lock cylinder 85, plus the longitudinal axis 120 of the lock cylinder 85, also the bolt extension assembly 175 and the twist lock assembly 225 with a lever 350 are shown.

Figure 3:
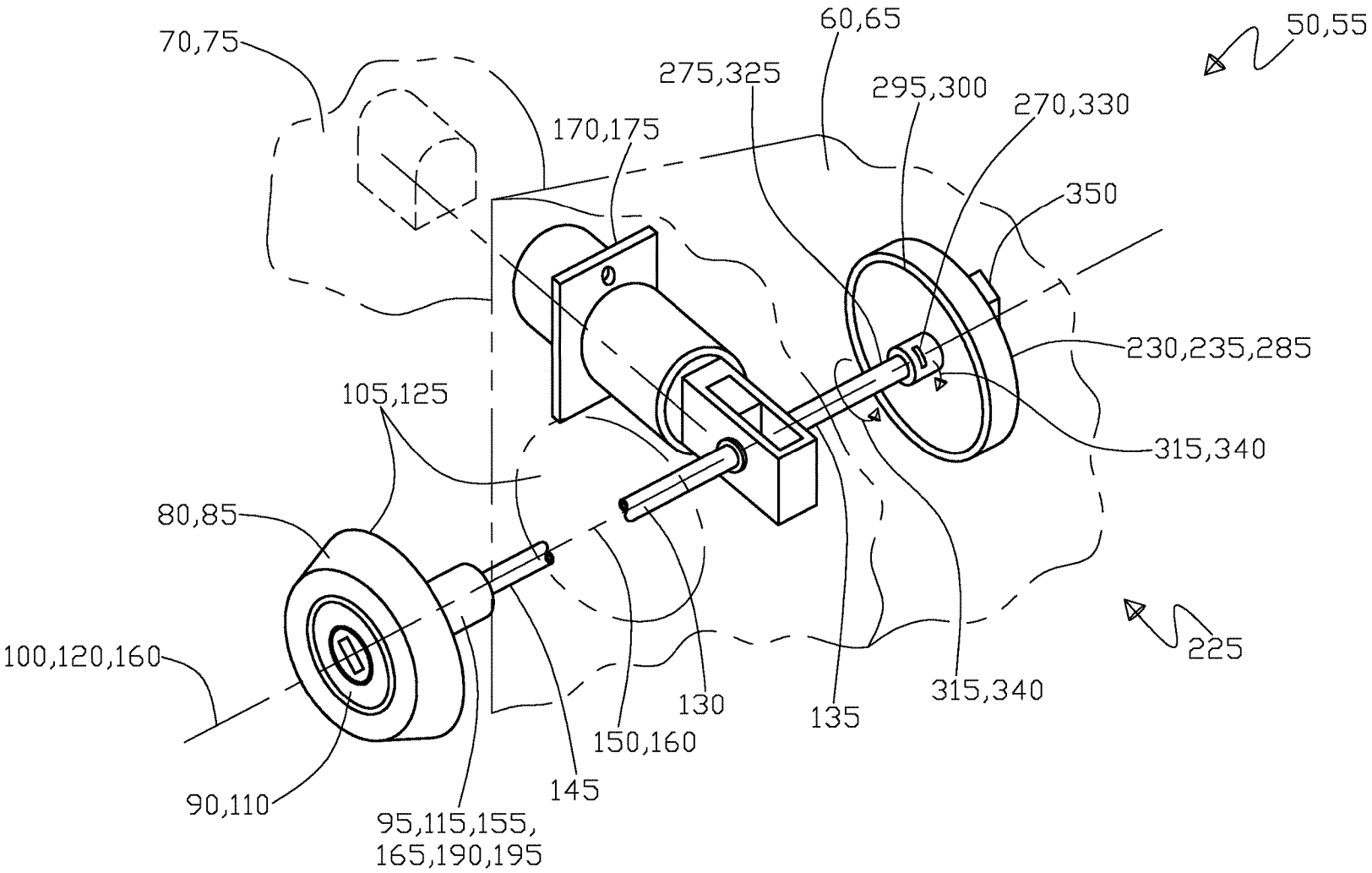
FIG. 3 shows an exploded perspective view of the lock apparatus that includes the extension beam with the lengthwise axis of the extension beam, the lock cylinder with the primary and secondary end portions of the lock cylinder, plus the longitudinal axis of the lock cylinder, also the bolt extension assembly and the twist lock assembly with the lever are shown, wherein further included are the door and door with the lock cylinder and the twist lock assembly both rotationally engaged to the door plus the bolt extension assembly that selectively engages and disengages the door frame.

Further, FIG. 3 shows an exploded perspective view of the lock apparatus 50 that includes the extension beam 130 with the lengthwise axis 150 of the extension beam 130, the lock cylinder 85 with the primary 90 and secondary 95 end portions of the lock cylinder 85. Also FIG. 3 shows the longitudinal axis 120 of the lock cylinder 85, also the bolt extension assembly 175 and the twist lock assembly 225 with the lever 350 are shown, wherein further included are the door 65 and door 65 with the lock cylinder 85 and the twist lock assembly 225 both rotationally engaged 125, 235 to the door 65 plus the bolt extension assembly 175 that selectively 355 engages and disengages the door frame 75.

Figure 4:
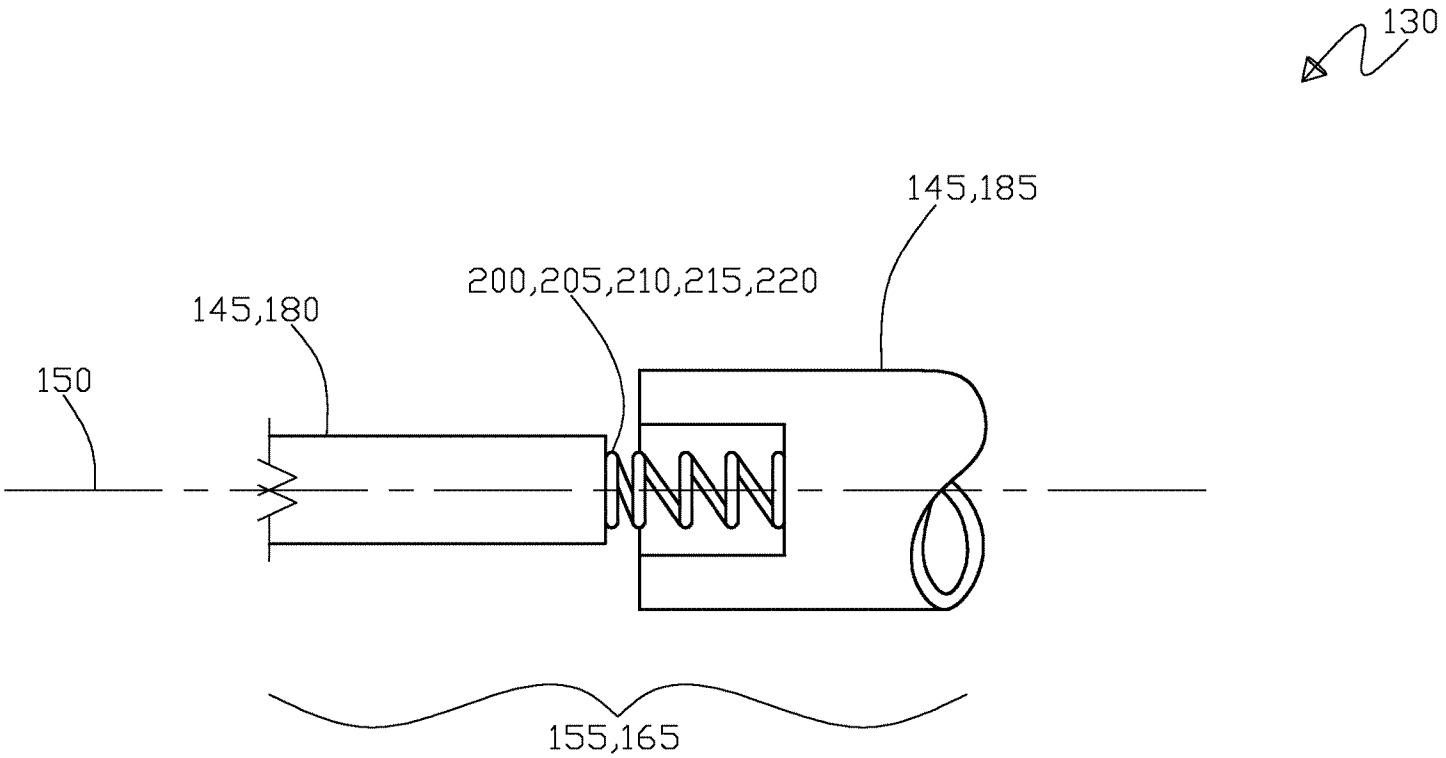
FIG. 4 shows a side elevation view of extension beam with the lengthwise axis with a second end portion male structure, plus the second end portion female portion of the structure, also with the structure to rotationally engage and disengage the first element secondary end portion, further a means for urging the male and female portions apart from one another to disengage the rotational engagement state as the not being rotationally engaged state is shown.

Next, FIG. 4 shows a side elevation view of extension beam 130 with the lengthwise axis 150 with a second end portion 145 male 180 structure 165, plus the second end portion 145 female portion 185 of the structure 165. FIG. 4 also shows the structure 165 to rotationally engage and disengage the first element 80 secondary end portion 95, further a means 200, 205 for urging the male 180 and female 185 portions apart from one another to disengage the rotational engagement state 155, 190, 195 as the not being rotationally engaged state 210, 215 is shown.

Figure 5:
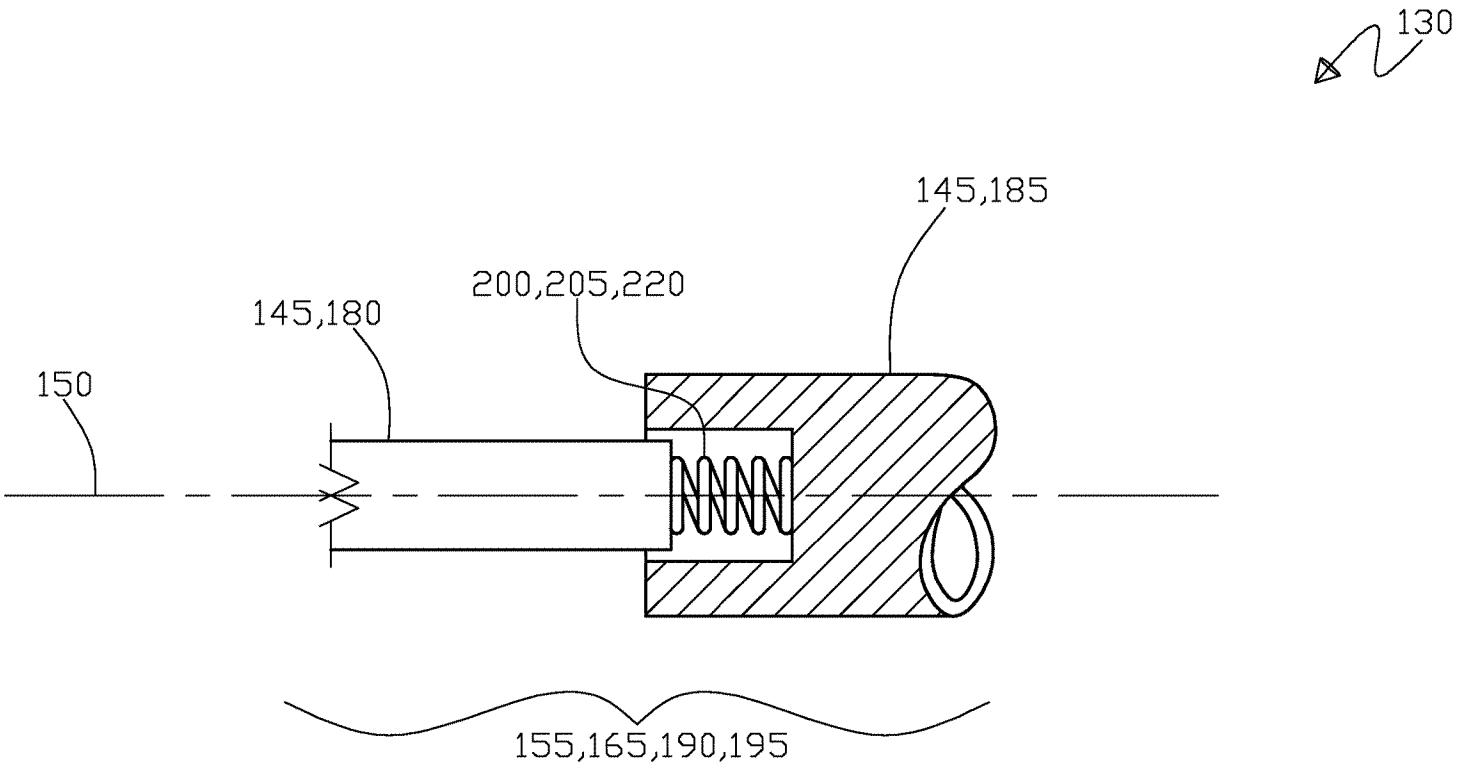
FIG. 5 shows a side elevation view of extension beam with the lengthwise axis with the second end portion male structure, plus the second end portion female portion of the structure, also with the structure to rotationally engage and disengage the first element secondary end portion, further the means for urging the male and female portions apart from one another to disengage the rotational engagement state as the being rotationally engaged state is shown.

Moving onward, FIG. 5 shows a side elevation view of extension beam 130 with the lengthwise axis 150 with the second end portion 145 male 180 structure 165, plus the second end portion 145 female portion 185 of the structure 165. In addition, FIG. 5 shows also with the structure 165 to rotationally engage and disengage the first element 80 secondary end portion 95, further the means 200, 205 for urging the male 180 and female 185 portions apart from one another to disengage the rotational engagement state 155, 190, 195 as the being rotationally engaged state is shown 190, 195.

Figure 6:
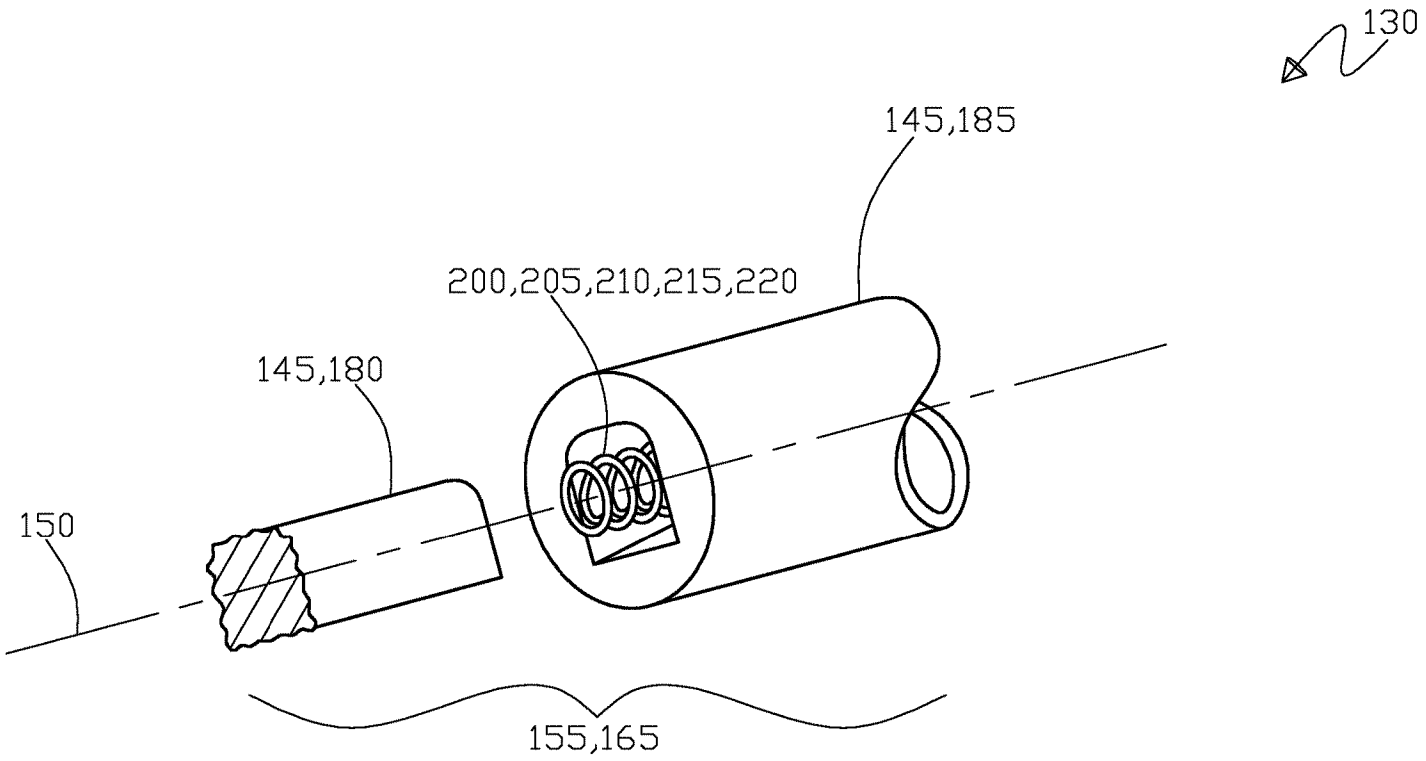
FIG. 6 shows an exploded perspective view of the extension beam with the lengthwise axis with the second end portion male structure, plus the second end portion female portion of the structure, also with the structure to rotationally engage and disengage the first element secondary end portion shown as a "D" shaped profile for the male and female portions-however any other shape would be acceptable, further the means for urging the male and female portions apart from one another to disengage the rotational engagement state as the not being rotationally engaged state is shown.

Continuing, FIG. 6 shows an exploded perspective view of the extension beam 130 with the lengthwise axis 150 with the second end portion 145 male structure 180, plus the second end portion 145 female portion 185 of the structure 165. FIG. 6 further shows the structure 165 to rotationally engage and disengage the first element 80 secondary end portion 95 shown as a "D" shaped profile for the male 180 and female 185 portions-however any other shape would be acceptable, further the means 200, 205 for urging the male 180 and female 185 portions apart from one another to disengage the rotational engagement state 155, 190, 195 as the not being rotationally engaged state is shown 210, 215.

Figure 7:
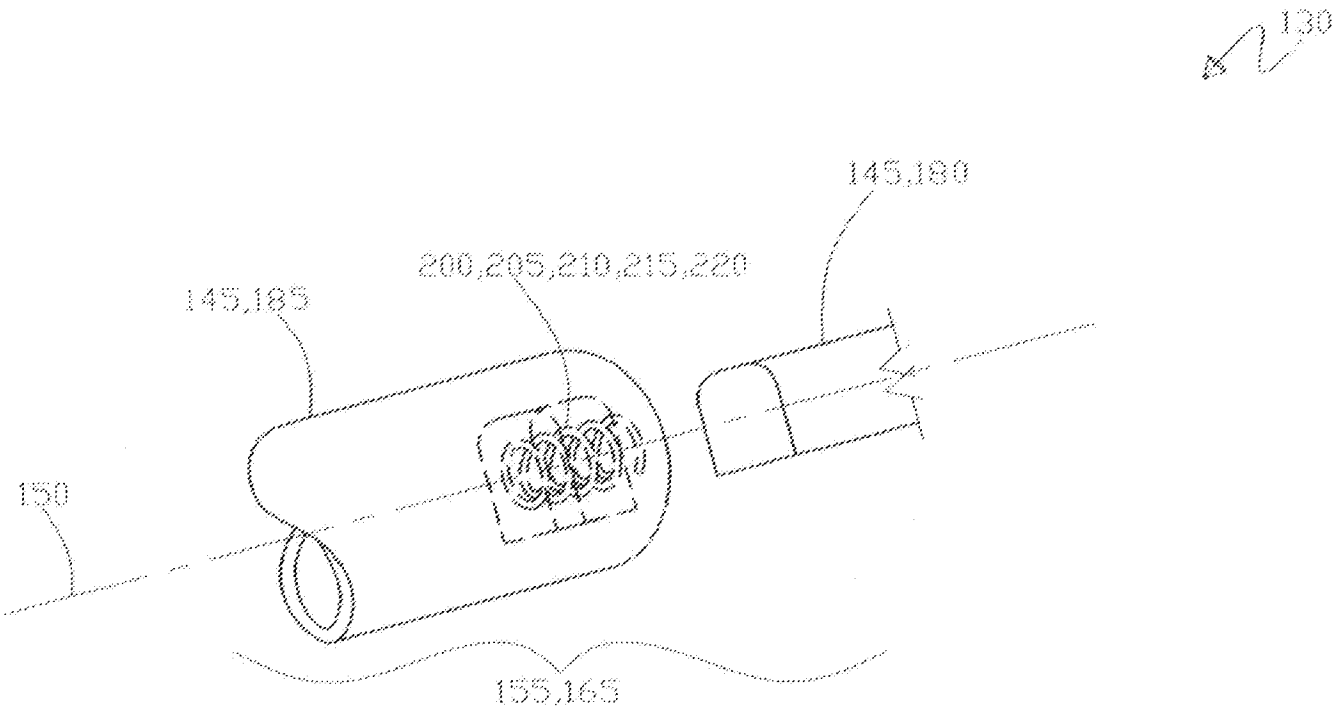

Next, FIG. 7 shows an exploded perspective view that is reversed from FIG. 6, wherein FIG. 7 shows the extension beam 130 with the lengthwise axis 150 with the second end portion 145 male structure 180, plus the second end portion 145 female portion 185 of the structure 165. In addition FIG. 7, also shows the structure 165 to rotationally engage and disengage the first element 80 secondary end portion 95 shown as the "D" shaped profile for the male 180 and female 185 portions-however any other shape would be acceptable, further the means 200, 205 for urging the male 180 and female 185 portion apart from one another to disengage the rotational engagement state 155, 190, 195 as the not being rotationally engaged state is shown 210, 215.

Figure 8:
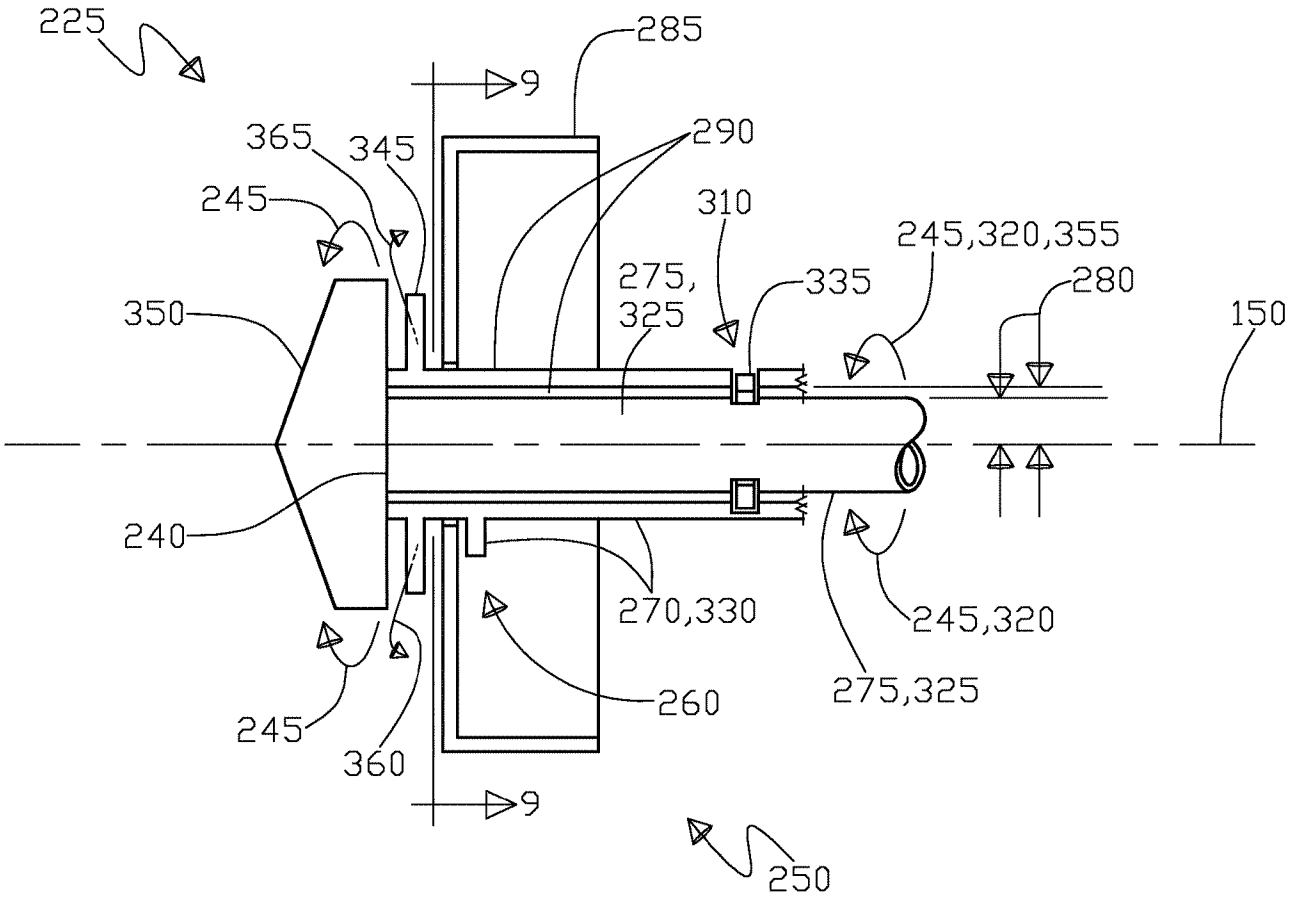
FIG. 8 shows a side elevation view of the twist lock assembly that includes the lengthwise axis, the lever, a thumbscrew, a retainer, a first extension element outer sleeve, a second extension element inner partial sleeve, a means to removably lock the first axial position, wherein a first axial position state is shown, also shown is the axially affixed position state of the first and second extension elements to one another along the lengthwise axis via an axial interface that is preferably a circular clip, noting that the first and second extension elements have free rotation movement to one another about the lengthwise axis.

Further, FIG. 8 shows a side elevation view of the twist lock assembly 225 that includes the lengthwise axis 150, the lever 350, a thumbscrew 345, a retainer 285, a first extension element 270 outer sleeve 330, a second extension element 275 inner partial sleeve 325, and a means 260 to removably lock the first axial position 250. In addition, FIG. 8 shows a first axial position state 250 being shown, also shown is the axially affixed position state 310 of the first 270 and second 275 extension elements to one another along the lengthwise axis 150 via an axial interface 305 that is preferably a circular clip 335, noting that the first 270 and second 275 extension elements have free rotation movement 315 to one another about the lengthwise axis 150.

Figure 9:
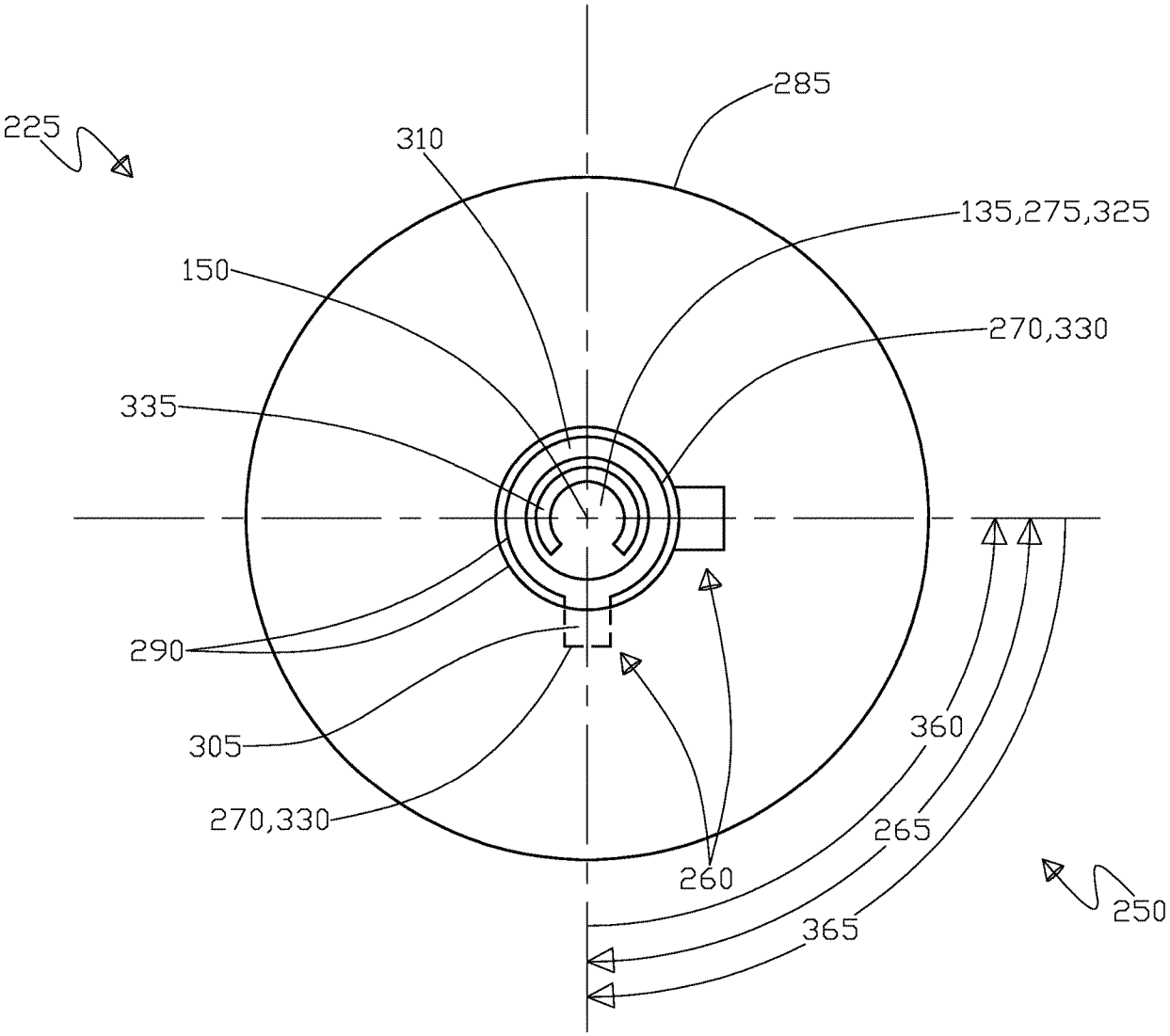
FIG. 9 shows an end elevation view of the twist lock assembly that includes the lengthwise axis, the retainer, the first extension element outer sleeve, the second extension element inner partial sleeve, the means to removably lock the first axial position, wherein the first axial position state is shown, also shown is the axially affixed position state of the first and second extension elements to one another along the lengthwise axis via the axial interface that is preferably the circular clip, noting that the first and second extension elements have free rotation movement to one another about the lengthwise axis.

Continuing, FIG. 9 shows an end elevation view of the twist lock assembly 225 that includes the lengthwise axis 150, the retainer 285, the first extension element 270 outer sleeve 330, the second extension element 275 inner partial sleeve 325, and the means 260 to removably lock the first axial position 250. FIG. 9 also shows the first axial position state 250 being shown, also the axially affixed position state 310 of the first 270 and second 275 extension elements to one another along the lengthwise axis 150 via the axial interface 305 that is preferably the circular clip 335, noting that the first 270 and second 275 extension elements have free rotation movement 315 to one another about the lengthwise axis 150.

Figure 10:
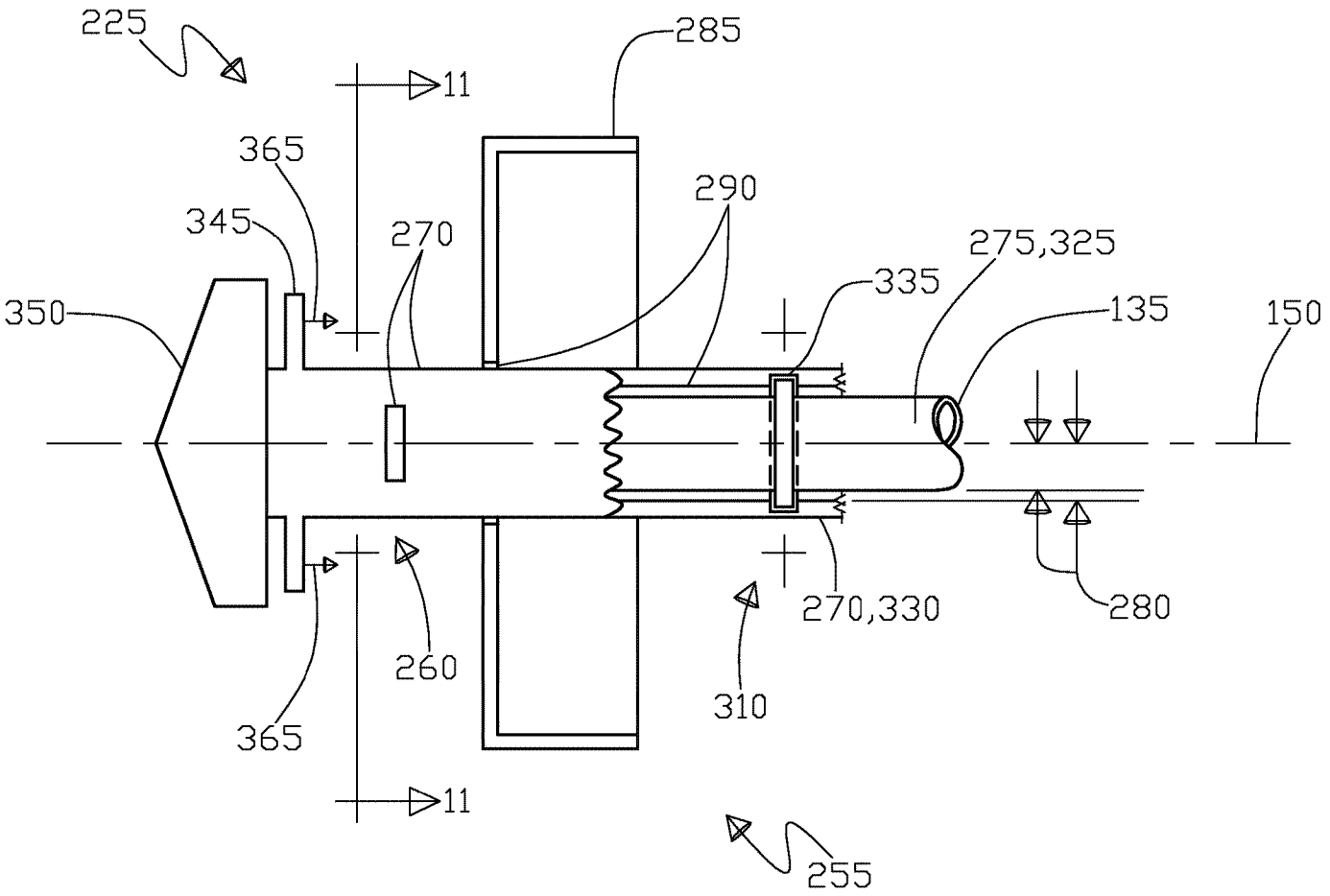
FIG. 10 shows a side elevation view of the twist lock assembly that includes the lengthwise axis, the lever, the thumbscrew, the retainer, the first extension element outer sleeve, the second extension element inner partial sleeve, the means to removably lock the first axial position, also shown is the free movement axial position state of the first and second extension elements to the retainer, further shown is the axially affixed position state of the first and second extension elements to one another along the lengthwise axis via the axial interface that is preferably the circular clip, noting that the first and second extension elements have free rotation movement to one another about the lengthwise axis.

Moving onward, FIG. 10 shows a side elevation view of the twist lock assembly 225 that includes the lengthwise axis 150, the lever 350, the thumbscrew 345, the retainer 285, the first extension element 270 outer sleeve 330, the second extension element 275 inner partial sleeve 325, the means 260 to removably lock the first axial position 250. Further FIG. 10 also shown is the free movement axial position state 255 of the first 270 and second 275 extension elements to the retainer 285, further shown is the axially affixed position state 310 of the first 270 and second 275 extension elements to one another along the lengthwise axis 150 via the axial interface 305 that is preferably the circular clip 335, noting that the first 270 and second 275 extension elements have free rotation movement 315 to one another about the lengthwise axis 150.

Figure 11:
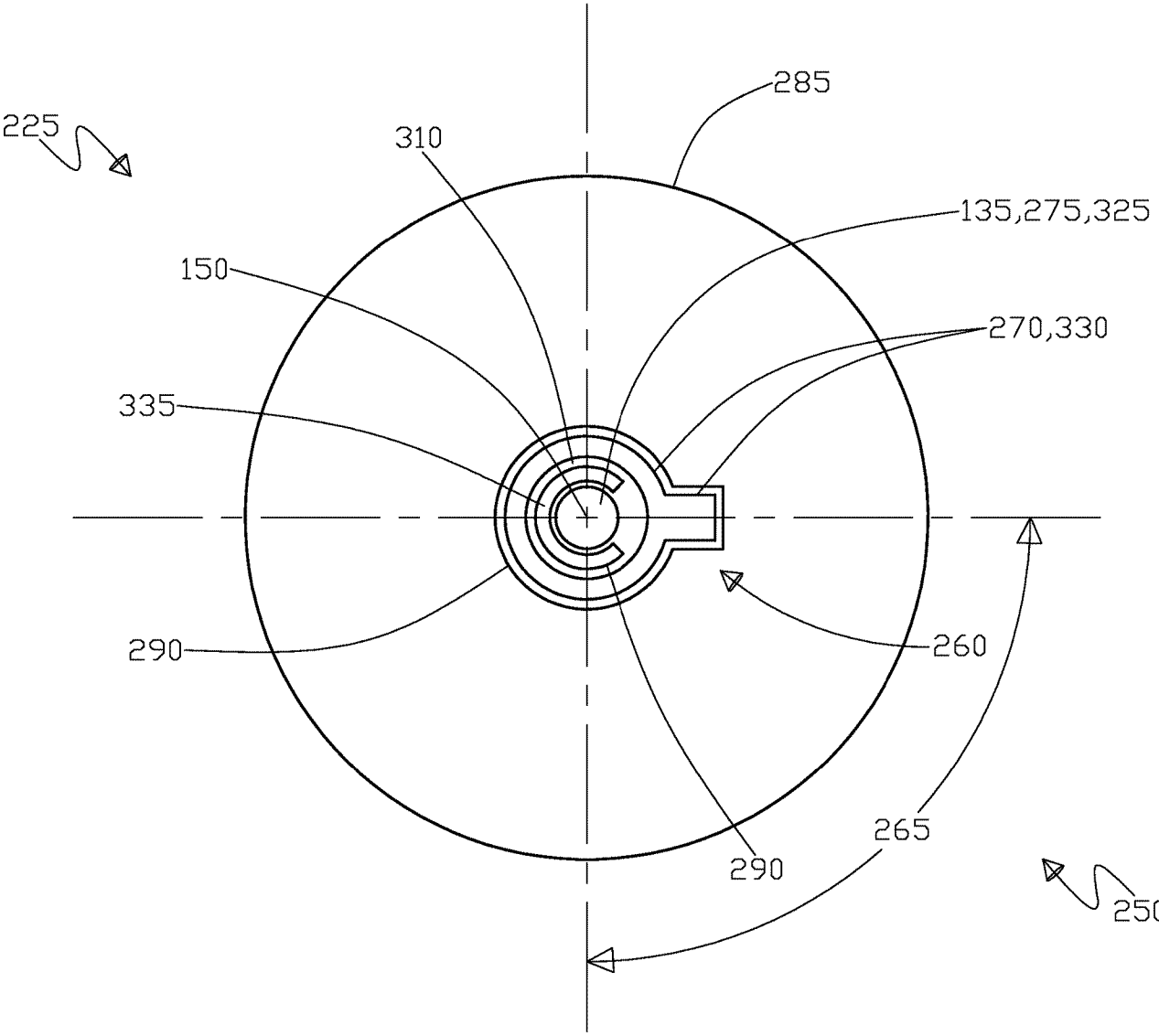
FIG. 11 shows an end elevation view of the twist lock assembly that includes the lengthwise axis, the retainer, the first extension element outer sleeve, the second extension element inner partial sleeve, the means to removably lock the first axial position, wherein the free movement axial position state is shown, also shown is the axially affixed position state of the first and second extension elements to one another along the lengthwise axis via the axial interface that is preferably the circular clip, noting that the first and second extension elements have free rotation movement to one another about the lengthwise axis.

Further, FIG. 11 shows an end elevation view of the twist lock assembly 225 that includes the lengthwise axis 150, the retainer 285, the first extension element 270 outer sleeve 330, the second extension element 275 inner partial sleeve 325, the means 260 to removably lock the first axial position 250. Wherein FIG. 11 also shows the free movement axial position state 255 is shown, also shown is the axially affixed position state 310 of the first 270 and second 275 extension elements to one another along the lengthwise axis 150 via the axial interface 305 that is preferably the circular clip 335, noting that the first 270 and second 275 extension elements have free rotation movement 315 to one another about the lengthwise axis 150.

Broadly, in referring to FIGS. 1 to 11, the present invention is of the lock apparatus 50 selectively securing and un-securing the first article 60 to the second article 70, the lock apparatus 50 comprises the first element 80 including the primary end portion 90 and the opposing secondary end portion 95 with the longitudinal axis 100 spanning therebetween, the first element 80 having a first element 80 rotational engagement 105 about the longitudinal axis 100 to the first article 60, see FIGS. 1, 2, and 3. Further included in the lock apparatus 50 is the extension beam 130 including the first end portion 135 and the opposing second end portion 145 with the lengthwise axis 150 spanning therebetween, the extension beam 130 having the extension beam 130 rotational engagement 155 about the lengthwise axis 150 to the first article 60, wherein the lengthwise axis 150 and the longitudinal axis 100 are coincident 160 to one another, see FIG. 3 in particular and also FIG. 2. Wherein the extension beam 130 second end portion 145 has structure 165 to selectively rotationally engage and disengage the first element 80 secondary end portion 95, see FIGS. 4, 5, 6, and 7.

Also included in the lock apparatus 50 is the means 170 to selectively engage and disengage the second article 70 that is driven from the extension beam 130, wherein operationally the extension beam 130 selectively rotationally engages the first element 80 and the extension beam 130 selectively engages and disengages the first article 60 to the second article 70, thus resulting in the extension beam 130 always being able to selectively engage and disengage the first article 60 to the second article 70 and the first element 80 only having an ability to selectively engage and disengage the first article 60 to the second article 70 when the first element 80 and the extension beam 130 are selectively rotationally engaged 190 to one another, see in particular FIGS. 4, 5, 6, and 7 in particular, plus FIGS. 2 and 3.

An option for the lock apparatus 50, wherein the structure 165 is preferably constructed of the male portion 180 that is received in the female portion 185 that includes the means 200 for urging the male 180 and female 185 portions apart from one another to operationally cause the default bias 210 toward the extension beam 130 second end portion 145 and the first element 80 secondary end portion 95 not being rotationally engaged, see in particular FIGS. 4, 6, and 7, wherein manual effort 365 is required to overcome the default bias 210 to rotationally engage 190 the extension beam 130 second end portion 145 and the first element 80 secondary end portion 95, see FIG. 5 in particular and also FIGS. 8 and 10.

Alternatively, for the lock apparatus 50, the male portion 180 is preferably disposed on the extension beam 130 second end portion 145 and the female portion 185 is preferably disposed on the first element 80 secondary end portion 95, as best shown in FIGS. 4, 5, 6, and 7.

Further, optionally for the lock apparatus 50, the means for urging 200 is preferably constructed of a spring 220 that is disposed within the female portion 185 to operationally have the urging movement 210 along the longitudinal axis 120, see in particular FIGS. 4, 5, 6, and 7.

Another alternative for the lock apparatus 50, can further comprise a twist lock assembly 225 that is rotationally engaged 230 to the first article 60, the twist lock assembly 225 is rotationally engaged 240 to the extension beam 130 first end portion 135, the twist lock assembly 225 having rotational movement 245 about the lengthwise axis 150, the twist lock assembly 225 also having a means 260 to removably lock the first axial position 250 along the lengthwise axis 150 and use a fixed amount of rotation 265 about the lengthwise axis 150 to unlock the first axial position 250 to the free movement axial state 255 along the lengthwise axis 150, see FIGS. 8, 9, 10, and 11. Wherein operationally the twist lock assembly 225 facilitates the structure 165 to rotationally engage the first element 80 secondary end portion 95 and the extension beam 130 second end portion 145 to one another in the first axial position 250 and to disengage the rotational engagement 190 at the first element 80 secondary end portion 95 and the extension beam 130 second end portion 145 when in the free movement axial state 255, see FIGS. 8 and 10 in particular.

As a continuing alternative for the lock apparatus 50, wherein the twist lock assembly 225 further comprises the first extension element 270 and the second extension element 275 that are both parallel 280 to the lengthwise axis 150 and the retainer 285 that is rotationally engaged 290 to the first 270 and second 275 extension elements and affixed 295 to the first article 60, wherein the first extension element 270 selectively axially interlocks 305 with the retainer 285 to form the first axial position 250, see FIGS. 8 and 9, and the first extension element 270 selectively unlocks with the retainer 285 to form the free movement axial state 255, see FIGS. 10 and 11. Wherein the first 270 and second 275 extension elements are axially affixed 310 to one another along the lengthwise axis 150 via an axial interface that allows independent rotational movement 315 about the lengthwise axis 150 as between the first 270 and second 275 extension elements, wherein the second extension element 275 is rotationally engaged to the extension beam 130 first end portion 135, see FIGS. 8 and 10. This is to operationally allow selective rotational engagement 190 and disengagement 200, 210 as between the second extension element 275 and said first element 80 secondary end portion 95 allowing independent engagement 190 of the means 170 to selectively engage and disengage the second article 70 via the second extension element 275, see FIGS. 8 to 11, FIGS. 4 to 7, and FIGS. 2 and 3.

As a further alternative for the lock apparatus 50, wherein the first 270 and second 275 extension elements are preferably constructed of an inner 325 and an outer 330 sleeve, wherein the first extension element 270 is the outer sleeve 330 and the second extension element 275 is the inner sleeve 325, the inner 325 and outer 330 sleeves are axially connected 310 through the circular clip 335 that affixes the inner 325 and outer 330 sleeves axially while allowing independent rotational movement 340 as between the inner 325 and outer 330 sleeves about the lengthwise axis 150, see FIGS. 8, 9, 10, and 11.

A continuing alternative for the lock apparatus 50, wherein the outer sleeve 330 further comprises a thumbscrew 345 type manual grabbing point and the inner sleeve 325 further comprises a lever 350 type manual grasping point to manually effectuate rotational motion 355 about the lengthwise axis 150 of the inner 325 and outer 330 sleeves, again see FIGS. 8, 9, 10, and 11.

Again broadly looking at FIGS. 1 to 11 for the dead bolt lock apparatus 55 for selectively securing and un-securing the door 65 to the door frame 75, the lock apparatus 55 comprises the lock cylinder 85 including the primary end portion 110 and the opposing secondary end portion 115 with the longitudinal axis 120 spanning therebetween, the lock cylinder 85 having a rotational engagement 125 about the longitudinal axis 120 to the door 65, as best shown in FIGS. 1 to 3.

Further included in the dead bolt apparatus 55 is the extension beam 130 including the first end portion 135 and the opposing second end portion 145 with the lengthwise axis 150 spanning therebetween, the extension beam 130 having the extension beam 130 rotational engagement about the lengthwise axis 150 to the lock cylinder 85, wherein the lengthwise axis 150 and the longitudinal axis 100 are coincident 160 to one another, wherein the extension beam 130 second end portion 145 has structure 165 to selectively rotationally engage and disengage the lock cylinder 85 secondary end portion 115, as best shown in FIGS. 2 and 3, plus FIGS. 4 to 7.

Also included in the dead bolt apparatus 55 is the bolt extension assembly 175 to selectively engage and disengage the door frame 75 that is driven from the extension beam 130, wherein operationally the extension beam 130 selectively rotationally engages 165 the lock cylinder 85 and the extension beam 130 selectively 175 engages and disengages the door 65 to the door frame 75, thus resulting in the extension beam 130 always being able to selectively 175 engage and disengage the door 65 to the door frame 75 and the lock cylinder 85 only having an ability to selectively engage and disengage the door 65 to the door frame 75 when the lock cylinder 85 and the extension beam 130 are selectively rotationally engaged 195 to one another, as best shown in FIGS. 4 to 7, also see FIGS. 2 and 3.

An option for the lock apparatus 55, wherein the structure 165 is preferably constructed of the male portion 180 that is received in the female portion 185 that includes the means 205 for urging the male 180 and female 185 portions apart from one another to operationally cause the default bias 215 toward the extension beam 130 second end portion 145 and the lock cylinder 85 secondary end portion 115 not being rotationally engaged 205, wherein manual effort 365 is required to overcome the default bias 215 to rotationally engage 195 the extension beam 130 second end portion 145 and the lock cylinder 85 secondary end portion 115, all as best shown in FIGS. 4 to 7, plus FIGS. 8 and 10.

Another option for the lock apparatus 55 wherein the male portion 180 is preferably disposed on the extension beam 130 second end portion 145 and the female portion 185 is preferably disposed on the lock cylinder 85 secondary end portion 115, as best shown in FIGS. 4 to 7.

A further option for the lock apparatus 55 wherein the means 205 for urging is preferably constructed of a spring 220 that is disposed within the female portion 185 to operationally have the urging movement 215 along the longitudinal axis 120, again see FIGS. 4 to 7.

Alternatively for the lock apparatus 55 can further comprise the twist lock assembly 225 that is rotationally engaged 235 to the door 65, also the twist lock assembly 225 is rotationally engaged 240 to the extension beam 130 first end portion 135, wherein the twist lock assembly 225 having rotational movement 245 about the lengthwise axis 150, see FIGS. 8 to 11. Also the twist lock assembly 225 having the means 260 to removably lock the first axial position 250 along the lengthwise axis 150 and use the fixed amount of rotation 265 about the lengthwise axis 150 to unlock the first axial position 250 to the free movement axial state 255 along the lengthwise axis 150, see again FIGS. 8 to 11.

Wherein operationally the twist lock assembly 225 facilitates the structure 165 to rotationally engage the lock cylinder 85 secondary end portion 115 and the extension beam 130 second end portion 145 to one another in the first axial position 250 and to disengage the rotational engagement 195 at the lock cylinder 85 secondary end portion 115 and the extension beam 130 second end portion 145 when in the free movement axial state 255, again see FIGS. 4 to 7.

A further alternative for the lock apparatus 55 wherein the twist lock assembly 225 further comprises the first extension element 270 and the second extension element 275 that are both parallel 280 to the lengthwise axis 150 and the retainer 285 that is rotationally engaged 290 to the first 270 and second 275 extension elements and affixed 295 to the door 65, wherein the first extension element 270 selectively axially interlocks 305 with the retainer 285 to form the first axial position 250, see FIGS. 8 and 9, and the first extension element 270 selectively unlocks with the retainer 285 to form the free movement axial state 255, see FIGS. 10 and 11.

Wherein the first 270 and second 275 extension elements are axially affixed 310 to one another along the lengthwise axis 150 via an axial interface that allows independent rotational movement 315 about the lengthwise axis 150 as between the first 270 and second 275 extension elements, wherein the second extension element 275 is rotationally engaged to the extension beam 130 first end portion 135, see FIGS. 8 and 10. This is to operationally allow selective rotational engagement 195 and disengagement 205, 210 as between the second extension element 275 and the lock cylinder 85 secondary end portion 115 allowing independent engagement 195 of the bolt extension assembly 175 to selectively engage and disengage the door frame 75 via the second extension element 275, see FIGS. 8 to 11, FIGS. 4 to 7, and FIGS. 2 and 3.

Another alternative for the lock apparatus 55, wherein the first 270 and second 275 extension elements are preferably constructed of the inner 325 and the outer sleeve 330, wherein the first extension element 270 is the outer sleeve 330 and the second extension element 275 is the inner sleeve 325, the inner 325 and outer 330 sleeves are axially connected 310 through the circular clip 335 that affixes the inner 325 and outer 330 sleeves axially while allowing independent rotational movement 340 as between the inner 325 and outer 330 sleeves that are co-axial to one another about the lengthwise axis 150, see FIGS. 8, 9, 10, and 11.

A continuing alternative for the lock apparatus 55, wherein the outer sleeve 330 further comprises the thumbscrew 345 type manual grabbing point and the inner sleeve 325 further comprises the lever 350 type manual grasping point to manually effectuate rotational motion 355 about the lengthwise axis 150 of the inner 325 and outer 330 sleeves, see FIGS. 8, 9, 10, and 11.

Method of Use

Looking at FIGS. 2 to 11, a method is disclosed for using the dead bolt lock apparatus 55 for selectively securing and un-securing the door 65 to a door frame 75, comprising the steps of firstly providing the dead bolt lock apparatus 55 as previously described. Secondly, a step of turning 355 the lever 350 manually about the lengthwise axis 150 that turns the extension beam 130 that subsequently causes the bolt extension assembly 175 to engage into the door frame 75 thus operationally securing the door 65 to the door frame 75, as best shown in FIGS. 2, 3, 8, and 10.

Thirdly a step of turning 360 the thumbscrew 345 manually about the lengthwise axis 150 to change from the first axial position lock 250 to the free movement axial state 255, thus operationally disengaging the extension beam 130 from the lock cylinder 85, thus disabling the lock cylinder 85 from being able to disengage the bolt extension assembly 175 from the door frame 75, see FIGS. 8 to 11, plus FIGS. 4 to 7, and further FIGS. 2 and 3.

Further as an option for the method for using the dead bolt lock apparatus 55, wherein the turning 360 the thumb screw 345 third step is reversed to moving manually or preferably pushing manually 365 the thumb screw 345 along the lengthwise axis 150 toward the lock cylinder 85 to engage the male 180 and female 185 portions thus taking the outer sleeve 330 from the free movement axial state 255 to the first axial position lock 250 with an additional manual turn of the lever 350 thus rotationally having the lock cylinder 85 rotationally engaged to the extension beam 130 that is rotationally engaged to the bolt extension assembly 175, see FIGS. 8 to 11.

Conclusion

Accordingly, the present invention of a lock apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. A lock apparatus for selectively securing and un-securing a first article to a second article, said lock apparatus comprising;

(a) a first element including a primary end portion and an opposing secondary end portion with a longitudinal axis spanning therebetween, said first element having a first element rotational engagement about said longitudinal axis that is adapted to attach to the first article;

(b) an extension beam including a first end portion and an opposing second end portion with a lengthwise axis spanning therebetween, said extension beam having an extension beam rotational engagement about said lengthwise axis that is adapted to attach to the first article, wherein said lengthwise axis and said longitudinal axis are coincident to one another, wherein said extension beam second end portion has a structure to selectively rotationally engage and disengage said first element secondary end portion, wherein said structure is constructed of a male portion that is received in a female portion that includes a means for urging said male and female portions apart from one another to operationally cause a default bias toward said extension beam second end portion and said first element secondary end portion not being rotationally engaged, wherein manual effort is required to overcome said default bias to rotationally engage said extension beam second end portion and said first element secondary end portion; and (c) a means to selectively engage and disengage the second article that is driven from said extension beam, wherein operationally said extension beam selectively rotationally engages said first element and said extension beam selectively engages and disengages the first article to the second article, thus resulting in said extension beam always being able to selectively engage and disengage the first article to the second article and said first element only having an ability to selectively engage and disengage the first article to the second article when said first element and said extension beam are said selectively rotationally engaged to one another.

2. A lock apparatus according to claim 1 wherein said male portion is disposed on said extension beam second end portion and said female portion is disposed on said first element secondary end portion.

3. A lock apparatus according to claim 2 wherein said means for urging is constructed of a spring that is disposed within said female portion to operationally have said urging movement along said longitudinal axis.

4. A lock apparatus according to claim 1 further comprising a twist lock assembly that is adapted to be rotationally engaged to the first article, said twist lock assembly is rotationally engaged to said extension beam first end portion, said twist lock assembly having rotational movement about said lengthwise axis, said twist lock assembly having a means to removably lock a first axial position along said lengthwise axis and use a fixed amount of rotation about said lengthwise axis to unlock said first axial position to a free movement axial state along said lengthwise axis, wherein operationally said twist lock assembly facilitates said structure to rotationally engage said first element secondary end portion and said extension beam second end portion to one another in said first axial position and to disengage said rotational engagement at said first element secondary end portion and said extension beam second end portion when in said free movement axial state.

5. A lock apparatus according to claim 4 wherein said twist lock assembly further comprises a first extension element and a second extension element that are both parallel to said lengthwise axis and a retainer that is rotationally engaged to said first and second extension elements and is adapted to be affixed to the first article, wherein said first extension element selectively axially interlocks with said retainer to form said first axial position and said first extension element selectively unlocks with said retainer to form said free movement axial state, wherein said first and second extension elements are axially affixed to one another along said lengthwise axis via an axial interface that allows independent rotational movement about said lengthwise axis as between said first and second extension elements, wherein said second extension element is rotationally engaged to said extension beam first end portion, to operationally allow selective rotational engagement and disengagement as between said second extension element and said first element secondary end portion allowing independent engagement of said means to selectively engage and disengage the second article via said second extension element.

6. A lock apparatus according to claim 5 wherein said first and second extension elements are constructed of an inner and an outer sleeve, wherein said first extension element is said outer sleeve and said second extension element is said inner sleeve, said inner and outer sleeves are axially connected through a circular clip that affixes said inner and outer sleeves axially while allowing independent rotational movement as between said inner and outer sleeves about said lengthwise axis.

7. A lock apparatus according to claim 6 wherein said outer sleeve further comprises a thumb disc type manual grabbing point and said inner sleeve further comprises a lever type manual grasping point to manually effectuate rotational motion about said lengthwise axis of said inner and outer sleeves.

8. A dead bolt lock apparatus for selectively securing and un-securing a door to a door frame, said lock apparatus comprising;

(a) a lock cylinder including a primary end portion and an opposing secondary end portion with a longitudinal axis spanning therebetween, said lock cylinder having a rotational engagement about said longitudinal axis that is adapted to attach to the door;

(b) an extension beam including a first end portion and an opposing second end portion with a lengthwise axis spanning therebetween, said extension beam having an extension beam rotational engagement about said lengthwise axis to said lock cylinder, wherein said lengthwise axis and said longitudinal axis are coincident to one another, wherein said extension beam second end portion has a structure to selectively rotationally engage and disengage said lock cylinder secondary end portion, wherein said structure is constructed of a male portion that is received in a female portion that includes a means for urging said male and female portions apart from one another to operationally cause a default bias toward said extension beam second end portion and said lock cylinder secondary end portion not being rotationally engaged, wherein manual effort is required to overcome said default bias to rotationally engage said extension beam second end portion and said lock cylinder secondary end portion; and (c) a bolt extension assembly to selectively engage and disengage the door frame that is driven from said extension beam, wherein operationally said extension beam selectively rotationally engages said lock cylinder and said extension beam selectively engages and disengages the door to the door frame, thus resulting in said extension beam always being able to selectively engage and disengage the door to the door frame and said lock cylinder only having an ability to selectively engage and disengage the door to the door frame when said lock cylinder and said extension beam are said selectively rotationally engaged to one another.

9. A lock apparatus according to claim 8 wherein said male portion is disposed on said extension beam second end portion and said female portion is disposed on said lock cylinder secondary end portion.

10. A lock apparatus according to claim 9 wherein said means for urging is constructed of a spring that is disposed within said female portion to operationally have said urging movement along said longitudinal axis.

11. A lock apparatus according to claim 8 further comprising a twist lock assembly that is adapted to be rotationally engaged to the door, said twist lock assembly is rotationally engaged to said extension beam first end portion, said twist lock assembly having rotational movement about said lengthwise axis, said twist lock assembly having a means to removably lock a first axial position along said lengthwise axis and use a fixed amount of rotation about said lengthwise axis to unlock said first axial position to a free movement axial state along said lengthwise axis, wherein operationally said twist lock assembly facilitates said structure to rotationally engage said lock cylinder secondary end portion and said extension beam second end portion to one another in said first axial position and to disengage said rotational engagement at said lock cylinder secondary end portion and said extension beam second end portion when in said free movement axial state.

12. A lock apparatus according to claim 11 wherein said twist lock assembly further comprises a first extension element and a second extension element that are both parallel to said lengthwise axis and a retainer that is rotationally engaged to said first and second extension elements and is adapted to be affixed to the door, wherein said first extension element selectively axially interlocks with said retainer to form said first axial position and said first extension element selectively unlocks with said retainer to form said free movement axial state, wherein said first and second extension elements are axially affixed to one another along said lengthwise axis via an axial interface that allows independent rotational movement about said lengthwise axis as between said first and second extension elements, wherein said second extension element is rotationally engaged to said extension beam first end portion, to operationally allow selective rotational engagement and disengagement as between said second extension element and said lock cylinder secondary end portion allowing independent engagement of said bolt extension assembly to selectively engage and disengage the door frame via said second extension element.

13. A lock apparatus according to claim 12 wherein said first and second extension elements are constructed of an inner and an outer sleeve, wherein said first extension element is said outer sleeve and said second extension element is said inner sleeve, said inner and outer sleeves are axially connected through a circular clip that affixes said inner and outer sleeves axially while allowing independent rotational movement as between said inner and outer sleeves that are co-axial to one another about said lengthwise axis.

14. A lock apparatus according to claim 13 wherein said outer sleeve further comprises a thumb disc type manual grabbing point and said inner sleeve further comprises a lever type manual grasping point to manually effectuate rotational motion about said lengthwise axis of said inner and outer sleeves.

15. A method for using a dead bolt lock apparatus for selectively securing and un-securing a door to a door frame, comprising the steps of:

(a) providing a dead bolt lock apparatus that has a lock cylinder including a primary end portion and an opposing secondary end portion with a longitudinal axis spanning therebetween, said lock cylinder having a rotational engagement about said longitudinal axis to the door, further included in the dead bolt lock apparatus is an extension beam including a first end portion and an opposing second end portion with a lengthwise axis spanning therebetween, said extension beam having an extension beam rotational engagement about said lengthwise axis to said lock cylinder, wherein said lengthwise axis and said longitudinal axis are coincident to one another, wherein said extension beam second end portion has a structure to selectively rotationally engage and disengage said lock cylinder secondary end portion, said structure is constructed of a male portion that is received in a female portion that includes a means for urging said male and female portions apart from one another to operationally cause a default bias toward said extension beam second end portion and said lock cylinder secondary end portion not being rotationally engaged, wherein manual effort is required to overcome said default bias to rotationally engage said extension beam second end portion and said lock cylinder secondary end portion, and a bolt extension assembly to selectively engage and disengage the door frame that is driven from said extension beam, wherein operationally said extension beam selectively rotationally engages said lock cylinder and said extension beam selectively engages and disengages the door to the door frame, thus resulting in said extension beam always being able to selectively engage and disengage the door to the door frame and said lock cylinder only having an ability to selectively engage and disengage the door to the door frame when said lock cylinder and said extension beam are said selectively rotationally engaged to one another, also the dead bolt lock apparatus has a twist lock assembly that is rotationally engaged to the door, said twist lock assembly is rotationally engaged to said extension beam first end portion, said twist lock assembly having rotational movement about said lengthwise axis, said twist lock assembly having a means to removably lock a first axial position along said lengthwise axis and use a fixed amount of rotation about said lengthwise axis to unlock said first axial position to a free movement axial state along said lengthwise axis, wherein operationally said twist lock assembly facilitates said structure to rotationally engage said lock cylinder secondary end portion and said extension beam second end portion to one another in said first axial position and to disengage said rotational engagement at said lock cylinder secondary end portion and said extension beam second end portion when in said free movement axial state, said twist lock assembly further comprises a first extension element and a second extension element that are both parallel to said lengthwise axis and a retainer that is rotationally engaged to said first and second extension elements and affixed to the door, wherein said first extension element selectively axially interlocks with said retainer to form said first axial position and said first extension element selectively unlocks with said retainer to form said free movement axial state, wherein said first and second extension elements are axially affixed to one another along said lengthwise axis via an axial interface that allows independent rotational movement about said lengthwise axis as between said first and second extension elements, wherein said second extension element is rotationally engaged to said extension beam first end portion, to operationally allow selective rotational engagement and disengagement as between said second extension element and said lock cylinder secondary end portion allowing independent engagement of said bolt extension assembly to selectively engage and disengage the door frame via said second extension element, wherein said first and second extension elements are constructed of an inner and an outer sleeve, wherein said first extension element is said outer sleeve and said second extension element is said inner sleeve, said inner and outer sleeves are axially connected through a circular clip that affixes said inner and outer sleeves axially while allowing independent rotational movement as between said inner and outer sleeves that are co-axial to one another about said lengthwise axis, wherein said outer sleeve further comprises a thumb disc type manual grabbing point and said inner sleeve further comprises a lever type manual grasping point to manually effectuate rotational motion about said lengthwise axis of said inner and outer sleeves;

(b) turning said lever manually about said lengthwise axis that turns said extension beam that subsequently causes said bolt extension assembly to engage the door frame thus operationally securing the door to the door frame; and (c) turning said thumb disc manually about said lengthwise axis to change from said first axial position to said free movement axial state, thus operationally disengaging said extension beam from said lock cylinder thus disabling said lock cylinder from being able to disengage said bolt extension assembly from the door frame.

16. A method for using a dead bolt lock apparatus according to claim 15 wherein said turning said thumb disc step is reversed to moving manually said thumb disc along said lengthwise axis toward said lock cylinder to engage said male and female portions thus taking said outer sleeve from said free movement axial state to said first axial position with an additional manual turn of said lever thus rotationally having said lock cylinder engaged to said extension beam that is engaged to said bolt extension assembly.

* * * * *